US009638421B2

(12) United States Patent
Imig

(10) Patent No.: US 9,638,421 B2
(45) Date of Patent: May 2, 2017

(54) STARTUP BURNER ASSEMBLY FOR RECOVERY BOILER AND METHOD

(71) Applicant: Andritz Inc., Glens Falls, NY (US)

(72) Inventor: Gregory Alan Imig, Suwanee, GA (US)

(73) Assignee: Andritz Inc., Glen Falls ( * ) Notice: Subject to any disclaimer, the term of this patent is extended or adjusted under 35 U.S.C. 154(b) by 290 days.

(21) Appl. No.: 14/620,319

(22) Filed: Feb. 12, 2015

(65) Prior Publication Data

US 2015/0233579 A1 Aug. 20, 2015

Related U.S. Application Data

(60) Provisional application No. 61/939,775, filed on Feb. 14, 2014.

(51) Int. Cl.

| | |
|---|---|
| ***F23D 14/46*** | (2006.01) |
| ***F23Q 13/04*** | (2006.01) |
| ***F23D 14/78*** | (2006.01) |
| ***F23C 5/06*** | (2006.01) |
| ***F23D 99/00*** | (2010.01) |

(52) U.S. Cl.

CPC ..... *F23Q 13/04* (2013.01); *F23C 5/06* (2013.01); *F23D 14/46* (2013.01); *F23D 14/78* (2013.01); *F23D 91/02* (2015.07)

(58) Field of Classification Search

CPC ..... F23Q 13/04; F23D 14/46; F23D 14/78; F23D 11/36; F23C 5/06; F23C 5/02

USPC ..... 431/6, 153, 186; 110/300, 347; 239/420

See application file for complete search history.

(56) References Cited

U.S. PATENT DOCUMENTS

| | | | | | |
|---|---|---|---|---|---|
| 4,781,576 | A * | 11/1988 | Dewitz | C10J 3/506 | 110/322 |
| 5,044,327 | A | 9/1991 | Hunt | | |
| 5,044,934 | A * | 9/1991 | Gutel | F23C 5/02 | 110/182.5 |
| 5,307,745 | A | 5/1994 | Higgins et al. | | |
| 5,564,632 | A * | 10/1996 | Prohazka | F23D 11/36 | 110/245 |
| 6,162,049 | A * | 12/2000 | Pellizzari | F23D 14/62 | 239/417.3 |
| 6,497,230 | B1 | 12/2002 | Higgins et al. | | |
| 8,997,665 | B2 * | 4/2015 | Hamasaki | F23D 14/22 | 110/229 |
| 2007/0272132 | A1 * | 11/2007 | Marx | F23D 1/02 | 110/263 |
| 2014/0199647 | A1 * | 7/2014 | Cadima | F23D 14/10 | 431/353 |
| 2015/0132704 | A1 * | 5/2015 | Buzinski | F23C 5/02 | 431/189 |

* cited by examiner

*Primary Examiner* — Gregory Huson
*Assistant Examiner* — Nikhil Mashruwala
(74) *Attorney, Agent, or Firm* — Kerri Hochgesang; Robert Joseph Hornung

(57) ABSTRACT

The present disclosure describes a recovery boiler startup burner assembly that can mitigate the harmful effects of smelt fouling, airflow interference, and operator exposure to hot air from the furnace and win box through use of an extractable startup burner and an isolation chamber engaged to a windbox. The present disclosure also describes a method for safely extracting a startup burner from an active recovery boiler as has method for inserting an extractable startup burner into a recovery boiler during operation.

10 Claims, 8 Drawing Sheets

STARTUP BURNER ASSEMBLY FOR RECOVERY BOILER AND METHOD

CROSS-RELATED APPLICATION

This application is a Non-Provisional Application claiming the benefits of U.S. Provisional Patent Application Ser. No. 61/939,775 filed Feb. 14, 2014, the entirety of which is incorporated herein by reference.

BACKGROUND OF THE INVENTION

1. Technical Field

The invention relates generally to startup burners and specifically to startup burners used in chemical recovery boilers in the pulp and paper industry.

2. Related Art

Chemical recovery boilers isolate useful compounds from manufacturing byproducts. In the pulp and paper industry, pulp mills typically use a manufacturing process in which wood chips or other lignocellulosic biomass are treated with chemical liquor comprising cooking chemicals. The wood chips or other lignocellulosic materials are then cooked in a digester at predetermined temperature and pressure to form a slurry comprising spent liquor and a rough pulp with inconsistent particle size. After cooking, equipment washes the spent chemical liquor from the rough pulp. The spent liquor is commonly known as "black liquor" and comprises organic and inorganic chemicals left over from the cooking process. The pulp is generally sent to other equipment for further refinement. The black liquor is eventually pumped to a chemical recovery boiler and processed to recover the cooking chemicals. Without recovering and reusing the cooking chemicals from the black liquor, the cost of industrial paper-making processes would be prohibitive.

Chemical recovery boilers generally evaporate excess moisture from black liquor solids, burn organic liquor components, supply heat for steam generation, and recover inorganic compounds—notably sodium sulfide and sodium carbonate. Some of these compounds can be re-causticized and used elsewhere in the manufacturing process.

In the recovery process, the black liquor is typically concentrated into a solution containing a solids concentration of above sixty percent by mass. Nozzles in the furnace wall then spray black liquor into a furnace. The nozzles are generally located in the bottom quarter of the furnace and may be several meters above the bottom of the furnace. The furnace is a reactor that generally dries and partially pyrolyzes the liquor droplets as they fall toward the bottom of the furnace. The furnace also evaporates, gasifies, oxidizes, and reduces, components within the black liquor to recover the cooking chemicals.

The partially dried and reacted black liquor accumulates in a mound at the bottom of the furnace known as a "char bed". Nozzles typically permit airflow into the furnace at a low, middle, and upper elevation. The air, together with the lignin, wood extracts, and other organic compounds maintain combustion in the furnace. Inorganic compounds are often reduced in the char bed into a molten smelt. The smelt may accumulate and flow out of the furnace through a smelt spout and into a collection tank. These reactions consume heat. As such, operators generally regulate and redistribute airflow and black liquor input, to promote and maintain combustion for efficient chemical recovery.

In traditional recovery boilers, the furnace is internally lined with a series of densely-arranged, high-pressure coolant-filled tubes. The coolant is commonly water and a collective series of tubes is generally known as a "water wall." To regulate temperature efficiently, the water wall tends to cover a large internal surface area. In some existing chemical recovery boilers, three inch coolant tubes are generally separated by one inch filler bars so as to form a gas-tight barrier enclosing the furnace.

To operate safely and efficiently, the furnace generally operates under negative pressure. A constant inflow of air near the base of the furnace is generally required to maintain combustion and to replace air and other gases that exit the recovery boiler near the top of the furnace. Air generally enters the otherwise gas-tight furnace through openings in the furnace water walls. Such openings include air ports and throats, which are designed to inject pressurized air. Ambient air generally flows through other openings, such as those for smelt spouts, due to the negative pressure in the furnace. For most such openings, the coolant tubes generally bend around the opening in the furnace wall.

Air manifolds or windboxes generally flank the throat and air port openings on the outer wall of the furnace. Large fans ducted to the windboxes can cause air to flow into the furnace through the various throats and air ports in the furnace walls.

Airflow is the primary variable of operation aside from the rate of black liquor input. Large quantities of air are generally forced through the narrow throat and air port openings to maintain combustion. The flow of air through a throat and, diffuser, or swirler is desirable to maintain auxiliary combustion from active startup burners. Unfortunately, conditions within the furnace contribute to the gradual obstruction of air flow as smelt slowly accumulates over the various openings. Over time, accumulations of frozen smelt on and around the coolant tubes can grow to obstruct the openings, thereby reducing an operator's ability to regulate combustion. Recovery boilers may need to be deactivated when smelt accumulations significantly interfere operation. This extensive maintenance period results in loss of production.

Temperature is another variable of operation. Startup burners help regulate internal furnace temperature. Startup burners are auxiliary burners that commonly fire natural gas, propane, and/or fuel oil, and are generally used to initiate combustion within the furnace after a period of dormancy. Once the startup burners increase furnace temperature to an established minimum, liquor firing can commence. Liquor firing is then increased until the liquor itself sustains combustion. The startup burners are then generally deactivated. Startup burns have also been used to provide supplementary heat to the furnace when liquor flow is interrupted or insufficient to meet boiler demand.

When inactive, the startup burner generally rests in the windbox within a burner housing adjacent to the throat opening. Radiant heat from the furnace can damage inactive startup burners. Moreover, splashes of black liquor through the throat openings can cause smelt fouling directly on the startup burner, particularly on the firing end of the startup burner, comprising, for example, the fuel nozzles, swirler, igniter assembly, and flame detection equipment. Smelt fouling can render the startup burner ineffective, unsafe, and unreliable.

There is a need to increase the intervals between recovery boiler maintenance and to reduce the amount of maintenance time while preserving or improving the operability of the recovery boiler after said maintenance.

SUMMARY OF THE INVENTION

The problems of loss of production caused by deactivating a chemical recovery boiler for the purpose of manually dislodging accumulations of smelt, airflow interference in the chemical recovery boiler, exposing operators to hot air from the furnace and windbox, and startup burner damage due to smelt spattering and radiant heat from the furnace is mitigated by using a system of isolation chambers engaged to the outer wall of a windbox to extract startup burners from windboxes engaged to the outer wall of the furnace of the chemical recovery boiler, such that the isolation chambers are configured to partially isolate the startup burner from the windbox and furnace environment before extraction. In alternative embodiments, the isolation chambers may isolate the extractable startup burner substantially completely from the windbox and furnace environment.

Some conventional startup burners may have a retraction feature whereby the burner can be manually or automatically retracted from an active position. That is, while the firing ends of the startup burners can be retracted from the furnace, the body and firing ends remain in the windbox proximate to the furnace and directly behind the wall openings in the furnace. Retracted firing ends are typically eight to sixteen inches from the furnace. By retracting an inactive conventional startup burner from the furnace, conventional burners have sought to reduce exposure to furnace temperature and smelt fouling. While conventional burners have been somewhat effective in prolonging the useful life of startup burners, conventional burners have significant drawbacks.

Conventional burners preclude startup burner maintenance while the recovery boiler is operational. The potential for smelt splatter renders human intervention unsafe. Hot air in the pressurized windbox and radiant heat from the furnace complicate human intervention. Conventional startup burners generally require constant exposure to moving air to prevent overheating. This tramp air flowing from the windbox through the throats and into the furnace can also provide oxygen to maintain combustion. Operators generally consider the amount of air entering the furnace as a variable when attempting to maintain a desirable combustion rate. To this end, some conventional startup burners are placed within housings having variable position dampers. The housings are likewise placed within the windbox. The variable position dampers can allow operators to affect the amount of air flowing over the startup burner to the boiler. However, the desire to preserve the startup burner from overheating prevents operators from closing variable position dampers completely.

Airflow within the windbox may become dynamic and irregular based partially on the oxygen demands of the furnace. Additionally, the startup burner obstructs the air flow in the housing, thereby facilitating an irregular and unpredictable insertion of air into the recovery boiler.

With regard to retracted startup burners, smelt fouling still occurs due to residual splashing of black liquor droplets through the throats and onto the firing end. The firing end generally includes a diffuser, or swirler, which can be used to direct or shape the flame emanating from the startup burner. The swirler's large surface area relative to the throat can increase the incidence of smelt accumulation on the swirler. Additionally, radiant heat from the furnace can damage the startup burner. The presence of retracted startup burners directly behind the occluded throats can interfere with operator's ability to clear the occlusions and perform necessary maintenance of the burners while the boiler remains operational.

Embodiments of the current disclosure comprise an isolation chamber located behind an extractable startup burner in a windbox. The assembly separates an operator from the pressurized hot air in the windbox and furnace thereby permitting operators to remove inactive startup burners safely while the recovery boiler is operational. Once the startup burner is removed, operators may use a rod, a cleaning brush mounted on a pole, or other suitable cleaning means to clean the throats manually. If the width of the isolation chamber is sufficiently wide, operators may clean multiple openings in the furnace wall through a single isolation chamber. Additionally, the exemplary assembly allows operators to replace or repair startup burners, as needed for optimal boiler operation, between scheduled outages.

Further, use of an extractable startup burner with an isolation chamber may eliminate or reduce the need for burner-cooling air. In conventional burners, variable position dampers in burner housings remain partially opened when the startup burner is inactive. The variable position dampers allow air from the windbox to cool the inactive startup burner and to counter effects of radiant heat. Throats in the furnace wall are generally uncovered when a startup burner is not in use, so tramp air in the burner housing used to cool the inactive startup burner may also flow into the furnace uncontrollably. This undesirable influx of air into the furnace can complicate an operator's ability to control and maintain optimal combustion conditions. Additionally, the presence of a conventional retracted startup burner in the windbox can interfere with desirable airflow.

Use of an extractable startup burner and isolation chamber as set forth in the present disclosure may allow operators to close fully variable position dampers in the burner housing and reduce or prevent tramp air from entering the furnace, thus improving air distribution control. Accordingly, it is an object of the present disclosure to improve air distribution control in a chemical recovery boiler—particularly in the windbox and through openings in the furnace wall.

A recovery boiler startup burner assembly has been conceived comprising: a furnace having areas defining openings in a furnace wall, a windbox exteriorly engaging the furnace wall, wherein the windbox is configured to contain pressurized combustion air, an isolation chamber exteriorly engaging a windbox wall, wherein the isolation chamber is aligned with an area defining an opening in the windbox wall and an area defining an opening in the furnace wall, a startup burner disposed within the windbox, the startup burner having a firing end and a supply end, wherein the firing end is aligned with the area defining an opening in the furnace wall and the supply end is aligned with the area defining an opening in the windbox wall, wherein the startup burner is configured to be extracted through the isolation chamber, and wherein the isolation chamber is configured to isolate an extracted portion of the startup burner from the windbox.

The isolation chamber may comprise a multi-door isolation chamber. In another exemplary embodiment, the isolation chamber may comprise a burner guide sleeve having a hinged door at one end and a seal plug at the other end. In still other exemplary embodiments, the isolation chamber may be configured to isolate the startup burner partially from the windbox. In yet other exemplary embodiments, the isolation chamber may be configured to isolate the startup burner from the windbox substantially completely.

In still other exemplary embodiments, the assembly for a recovery boiler may further comprise a cooling carriage comprising a structural brace having a first end and a second end, the second end being mounted to an outer wall of the recovery boiler and the first end being engaged to a first end of a main support beam, a second end of the main support beam being engaged to the outer wall of the recovery boiler, the cooling carriage may further comprise a carrier assembly linkage having at least one first end and at least one second end having at least one roller rotatably mounted to the at least one second end of the carrier assembly linkage.

The cooling carriage may further comprise a local temperature display. The local temperature display may be a contact-type temperature display, such as a resistance temperature detector ("RTD") or a thermocouple detector. In other exemplary embodiments, the local temperature display may be a non-contact type display such as an infrared thermometer or a laser thermometer.

A method has been conceived for extracting a startup burner comprising: deactivating a startup burner, disconnecting wires and hoses from the startup burner and an igniter assembly, withdrawing the startup burner from a throat in a furnace wall, removing the igniter assembly from the startup burner, lowering a support brace to the startup burner, withdrawing the startup burner into an inner space defined by the multi-door isolation chamber, closing at least one inner door of the multi-door isolation chamber to support the startup burner, withdrawing the startup burner through the inner space defined by the multi-door isolation chamber, opening at least one outer door of the multi-door isolation chamber, closing the inner door of the multi-door isolation chamber, and removing the startup burner from the inner space of the multi-door isolation chamber.

A multi-door isolation chamber for use with a recovery boiler windbox has been conceived comprising: a multi-door isolation chamber disposed proximate to a windbox opening defined by an outer wall of a windbox, at least one inner door configured to occlude partially the windbox opening and support a startup burner, and at least one outer door configured to occlude a multi-door isolation chamber opening defined by an outer face of the multi-door isolation chamber.

Another method has been conceived for extracting a startup burner from a recovery boiler comprising: shutting down a startup burner; disconnecting wires and hoses from the startup burner and an igniter assembly; withdrawing the startup burner from a throat in a furnace wall; removing the igniter assembly from the startup burner; lowering a support brace to the startup burner; closing the first inner door of the multi-door isolation chamber to support the support brace and startup burner; withdrawing the support brace with the startup burner through a first inner door of a multi-door isolation chamber into an inner space defined by the multi-door isolation chamber; closing a second inner door of the multi-door isolation chamber to substantially isolate the support brace with the startup burner in the inner space of the multi-door isolation chamber; opening at least one outer door of the multi-door isolation chamber; and removing the startup burner from the inner space of the multi-door isolation chamber.

A method for cleaning smelt accumulations in a recovery boiler during operation has been conceived comprising: shutting down a startup burner, disconnecting wires and hoses from the startup burner and an igniter assembly, withdrawing the startup burner from a throat in a furnace wall, removing the igniter assembly from the startup burner, withdrawing the startup burner into an inner space defined by the multi-door isolation chamber, closing at least one inner door of the multi-door isolation chamber, withdrawing the startup burner through the at least one inner door of a multi-door isolation chamber to substantially isolate the startup burner in an inner space defined by the multi-door isolation chamber, opening at least one outer door of the isolation chamber, removing the startup burner from the isolation chamber, and extending a rod through the multi-door isolation chamber to dislodge smelt accumulations from the throat in the furnace wall.

The method for cleaning smelt accumulations may further comprise extending a carrier assembly linkage of a cooling carrier into a path of the startup burner, placing the startup burner on rollers extending from the carrier assembly linkage, and allowing a hot end of the startup burner to cool on the rollers.

A method has been conceived for replacing an extractable startup burner in a recovery boiler during operation comprising: aligning a support brace with an outer door of an isolation chamber; mounting a startup burner on a support brace, opening at least one outer door of the isolation chamber, inserting a startup burner into an inner space of the isolation chamber, closing the at least one outer door of the isolation chamber to support the startup burner, closing a second outer door of the isolation chamber to substantially isolate the startup burner in the inner space of the isolation chamber; extending the startup burner from the at least one inner door toward a throat in a furnace wall; and connecting wires and hoses to a startup burner and an igniter assembly.

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE INVENTION

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

The present disclosure describes an isolation chamber that may be used with a startup burner configured to be removed or replaced while the boiler is operating. Natural gas, oil, propane, or other fuel known to those having ordinary skill in the art may fuel the startup burner. Although the startup burner may be used in boilers or process furnaces generally, subsequent exemplary uses will refer to recovery boilers used in the pulp and paper industry.

Figure 1:
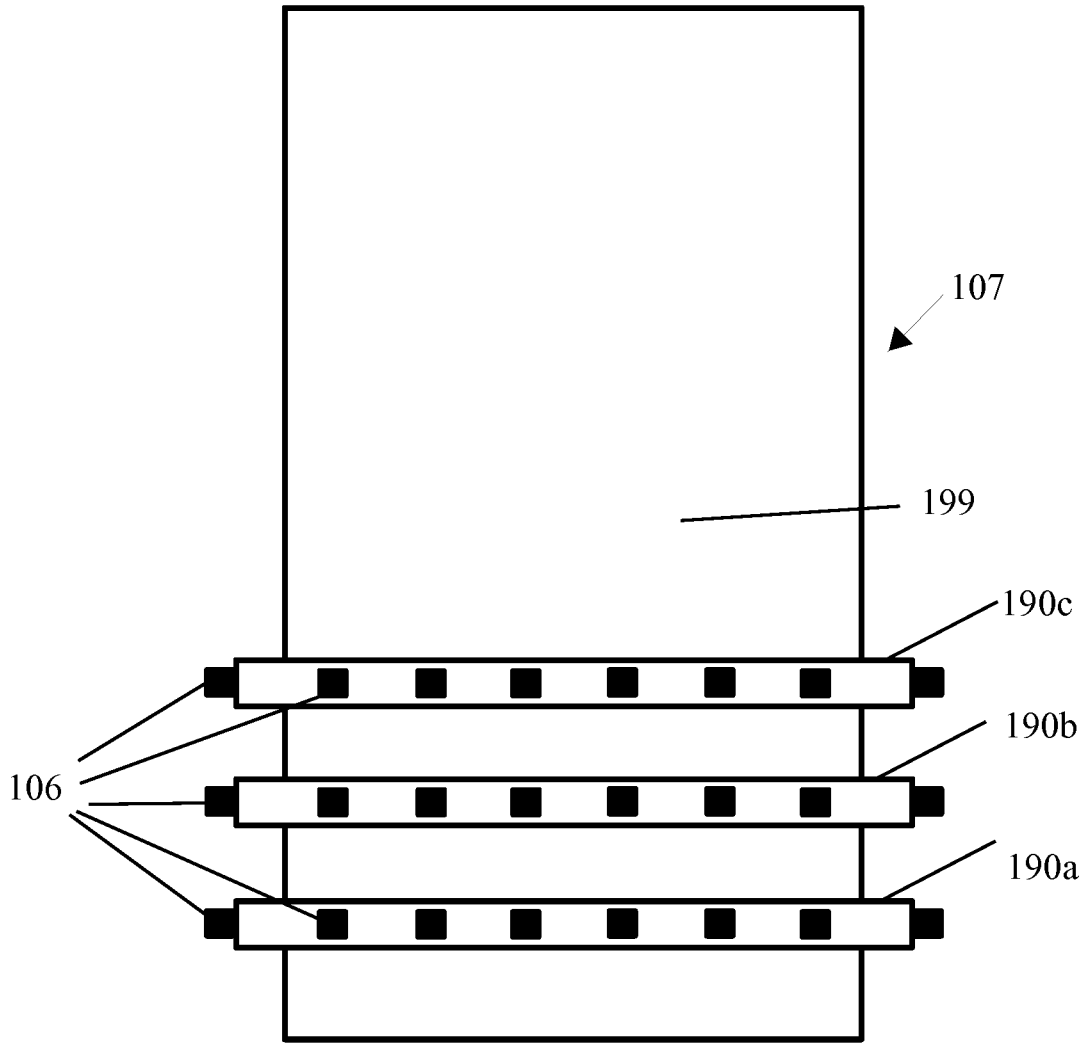
FIG. 1 is a side-view of an exemplary embodiment of a recovery boiler with windboxes and several multi-door isolation chambers engaged to the sides of the windboxes.

FIG. 1 depicts an exemplary embodiment of the isolation chamber 106 attached to windboxes 190 of a recovery boiler 107. The windboxes 190 generally span the sides of the furnace 199 horizontally and may contain throats (FIG. 2, 240), housings (FIG. 4, 491), startup burners (FIG. 2, 200), or other instruments such as air nozzles or probes to record furnace conditions (not depicted). Recovery boilers 107 generally have a primary windbox 190*a*, a secondary windbox 190*b*, and tertiary windbox 190*c* spanning the sides of the furnace 199. The primary windbox 190*a* is generally closest to the ground and the tertiary windbox 190*c* is generally furthest from the ground. In certain exemplary embodiments, exemplary isolation chambers 106 may be attached to the primary windbox 190*a* and secondary windbox 190*b*. In other embodiments, at least one exemplary isolation chamber 106 may be attached to the primary windbox 190*a*. In still other embodiments, exemplary isolation chambers 106 may be attached to any one of the primary windbox 190*a*, secondary windbox 190*b*, or tertiary windbox 190*c*. In other exemplary embodiments, at least one exemplary isolation chamber 106 may be attached to each of the primary windbox 190*a*, secondary windbox 190*b*, and tertiary windbox 190*c*.

Figure 2A:
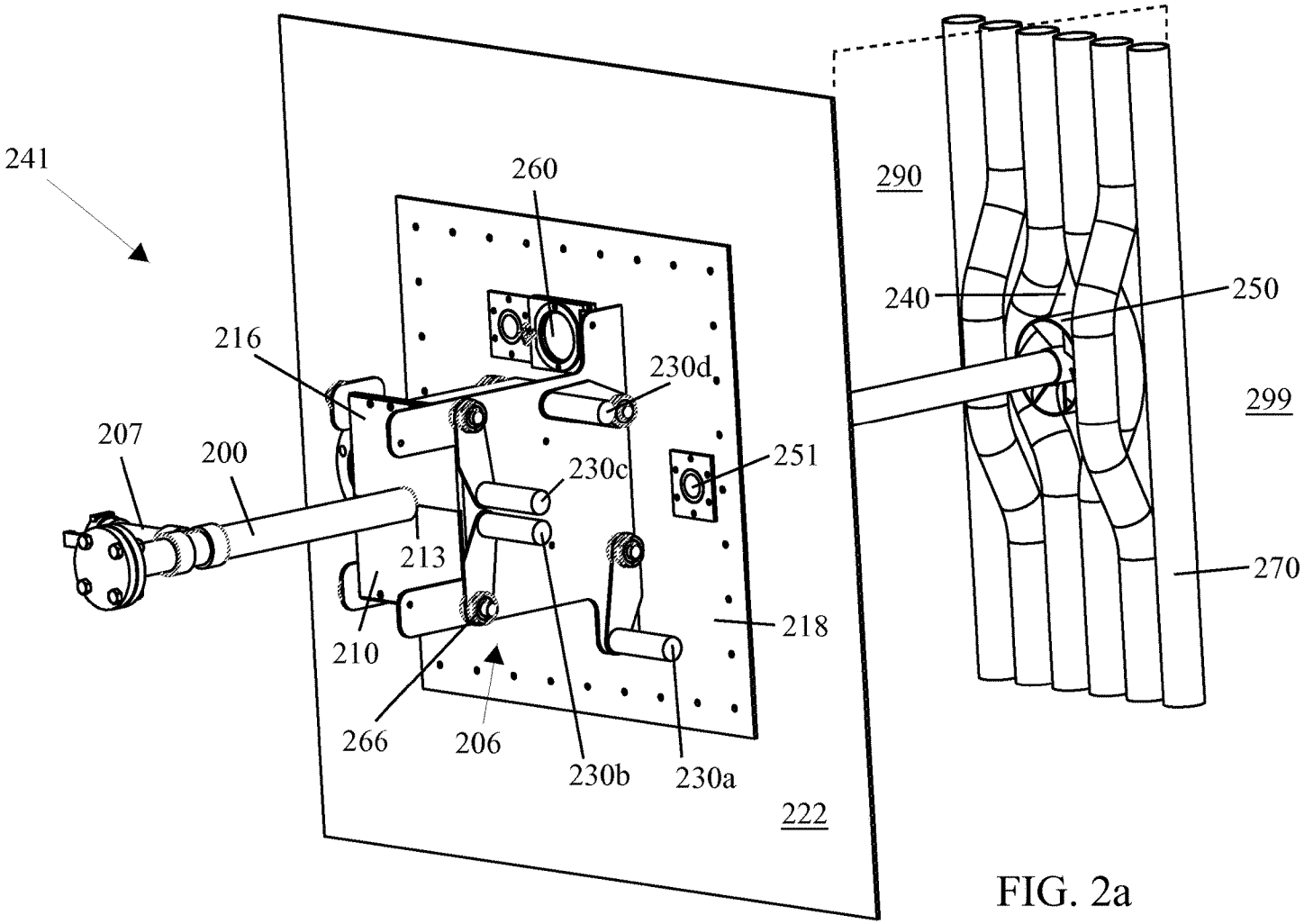
FIG. 2*a* is a perspective view of an exemplary embodiment of the multi-door isolation chamber, the windbox, and the path by which the startup burner may be removed from the windbox.

FIG. 2*a* depicts a perspective view of the exemplary multi-door isolation chamber 206 engaged to a mounting plate 218 secured to the outer wall 222 of the windbox 290. In this exemplary embodiment, the multi-door isolation chamber 206 is generally in the shape of a rectangular prism (i.e. box-shaped); however, on other embodiments, the multi-door isolation chamber 206 may be generally cylindrical, generally in the shape of a geometric prism having greater than three edges, or generally irregularly shaped. A generally irregularly shaped isolation chamber 206 may have a sample cross sectional area at a first position (e.g. a measurement of cross sectional area measured along a first plane) that differs from a sample cross sectional area at a second position (e.g. a measurement of cross sectional area measured along a second plane parallel to the first plane).

The startup burner 200 may comprise an inlet 207 through which natural gas, air, or other fuel enters the startup burner 200. The inlet 207 is generally located at the supply end of the startup burner. The fuel generally flows along the length of the startup burner 200 and into the furnace 299. Air enters the furnace through throat 240, and may flow across swirler 250. The swirler rotates thereby aiding fuel and air mixing. Operators may monitor the fuel input and amount of air entering the furnace 299 from the windbox 290 to increase furnace temperature and melt or burn away smelt accumulations. During operation, a startup burner 200 may extend through the multi-door isolation chamber 206 and traverse the windbox 290. Water wall tubes 270 may bend to create an open area, which defines a throat 240. In other embodiments, the throats 240 may be further defined by a reinforcing element (not depicted) disposed within the opening defined by the water wall tubes 270. The reinforcing element may generally conform to the hole defined by the bend water wall tubes 270 and may be made from carbon steel or other material configured to withstand furnace heat.

An exemplary startup burner assembly 241 may have an observation port 260 through which operators may view the inside of the windbox 290, throat 240, and furnace 299. An operator may look through the observation port 260 to determine the amount of smelt accumulation around the throat 240. If smelt has accumulated, an operator may insert a rod (not depicted) through port 251 to dislodge the smelt accumulations while the recovery boiler is operational. In an exemplary method, an operator may insert the rod through the multi-door isolation chamber 206.

Figure 2B:
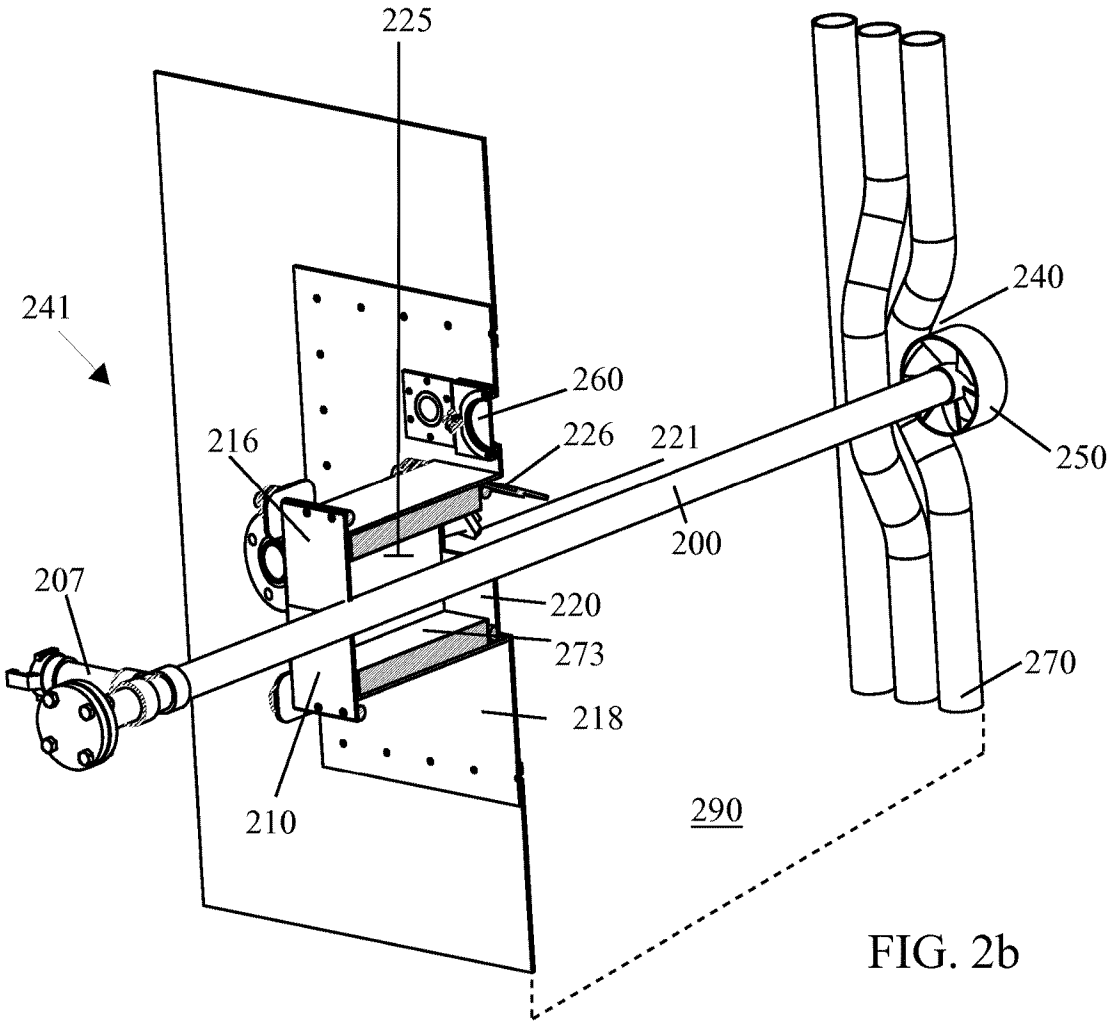
FIG. 2*b* is a cross-sectional view of an exemplary embodiment of the multi-door isolation chamber, the windbox, and the path by which the startup burner may be removed from the windbox.

In the exemplary startup burner assembly 241 of FIG. 2*a*, the multi-door isolation chamber 206 is configured isolate the startup burner 200 from the furnace 299 and windbox 290 by using outer doors 210, 216 and inner doors (FIG. 2*b* 220, 226). The outer door comprises a bottom outer door 210 engaging handle 230*b* and a top outer door 216 engaging handle 230*c*. Handle 230*d* engages top inner door 226, while handle 230*a* engages bottom inner door 220. The outer doors 210, 216 and inner doors 220, 226 desirably open inwardly toward the furnace 299 and windbox 290. In this configuration, pressure generated by the furnace 299 and windbox 290 exerts an outward force on the inner doors 220, 226 and outer doors 210, 216. Inwardly opening doors may reduce the risk of sudden release of hot air and potential smelt splatter if the pivot mechanism 266 fails. If both inner doors 220, 226 and outer doors 210, 216 were configured to open outwardly, the pivot mechanisms 266 keeping the inner doors 220, 226 and outer doors 210, 216 closed would be more likely to experience prolonged stress due to the windbox-pressure and therefore be more likely to fail spontaneously and expose personnel and nearby equipment to hot, high-pressure air from the windbox 290. Although the inner doors 220, 226 and outer doors 210, 216 desirably open inwardly, other exemplary embodiments may comprise one or more inner doors 220, 226 and outer doors 210, 216 opening outwardly away from the windbox 290 and furnace 299. The bottom inner door 220 and bottom outer door 210 pivot at the bottom of the multi-door isolation chamber 206 in FIG. 2*a*. Likewise, the top inner door 226 and top outer door 216 pivot at the top of the multi-door isolation chamber 206. In other exemplary embodiments, the outer and inner door may comprise two or more doors, one or more of which may pivot on the right side of the isolation chamber 206, and one or more of which may pivot on the left side of the isolation chamber 206 (see FIG. 5). In other exemplary configurations, an odd number of outer doors may be used. In yet other embodiments, an odd number of inner doors may be used. The bottom outer door 210 may have a cut-out portion 213 configured to support the startup burner 200. The outer door may be a singular outer door. The inner door may be a singular inner door. Nothing in this disclosure limits the combination of aspects of one embodiment with aspects of one or more other embodiments.

FIG. 2*b* is a cross sectional view of an exemplary startup burner assembly 241. The startup burner 200 may be extracted through the windbox 290 and bottom inner door 220 of the multi-door isolation chamber 206. Operators may then use handle 230*a* to close the bottom inner door 220 of the multi-door isolation chamber 206. In this exemplary embodiment, the bottom inner door 220 may be a plate of carbon steel or other material suitable to withstand the heat and pressure of the windbox 290 and an occasional splatter of black liquor (not pictured) through the throats 240 of the furnace 299. Bottom inner door 220 may be configured to provide support for the startup burner 200 as the startup burner 200 is extracted from the windbox 290. The bottom inner door 220, when closed, may occupy a portion of the opening 221 created in windbox mounting plate 218. In other exemplary embodiments, the bottom inner door 220, when closed, may be configured to occupy substantially all of the opening 221; in this manner, a portion of the startup burner 200 may be substantially completely isolated in the internal space 225 of the multi-door isolation chamber 206.

In still other exemplary embodiments, the bottom inner door 220, when closed, may be configured to occupy half of the opening 221. In yet other exemplary embodiments, the bottom inner door 220, when closed, may be configured to occupy a portion of the opening 221. In this manner, a portion of the startup burner 200 may be partially isolated in the internal space 225 defined by the multi-door isolation chamber 206.

Thus protected from the furnace environment and so isolated from the windbox 290, an operator may open the outer door 210 of the multi-door isolation chamber 206 and remove the startup burner 200 from the multi-door isolation chamber 206 with reduced risk of burns due to hot air or molten smelt. In addition to being protected, the operator, by extracting the startup burner 200, may extend the useful life of the startup burner 200 by removing the startup burner 200 from the recovery boiler completely. By having the startup burner 200 completely removed from the recovery boiler, the operator may maintain, repair, or replace the startup burner 200 while the recovery boiler is operational, while substantially eliminating the risk of injury from the recovery boiler.

The outer doors 210, 216 and inner doors 220, 226 desirably open inwardly toward the windbox 290 and furnace 299. The pressure created by the furnace 299 and moving air within the windbox 290 exerts a force against the closed inner doors 220, 226 and outer doors 210, 216. By opening inwardly, the closed inner doors 220, 226 and outer doors 210, 216 remain locked in position, thereby reducing the risk that door failure will expose operators to immediate harm. An insulating liner 273 may be disposed within the multi-door isolation chamber 206.

Figure 3:
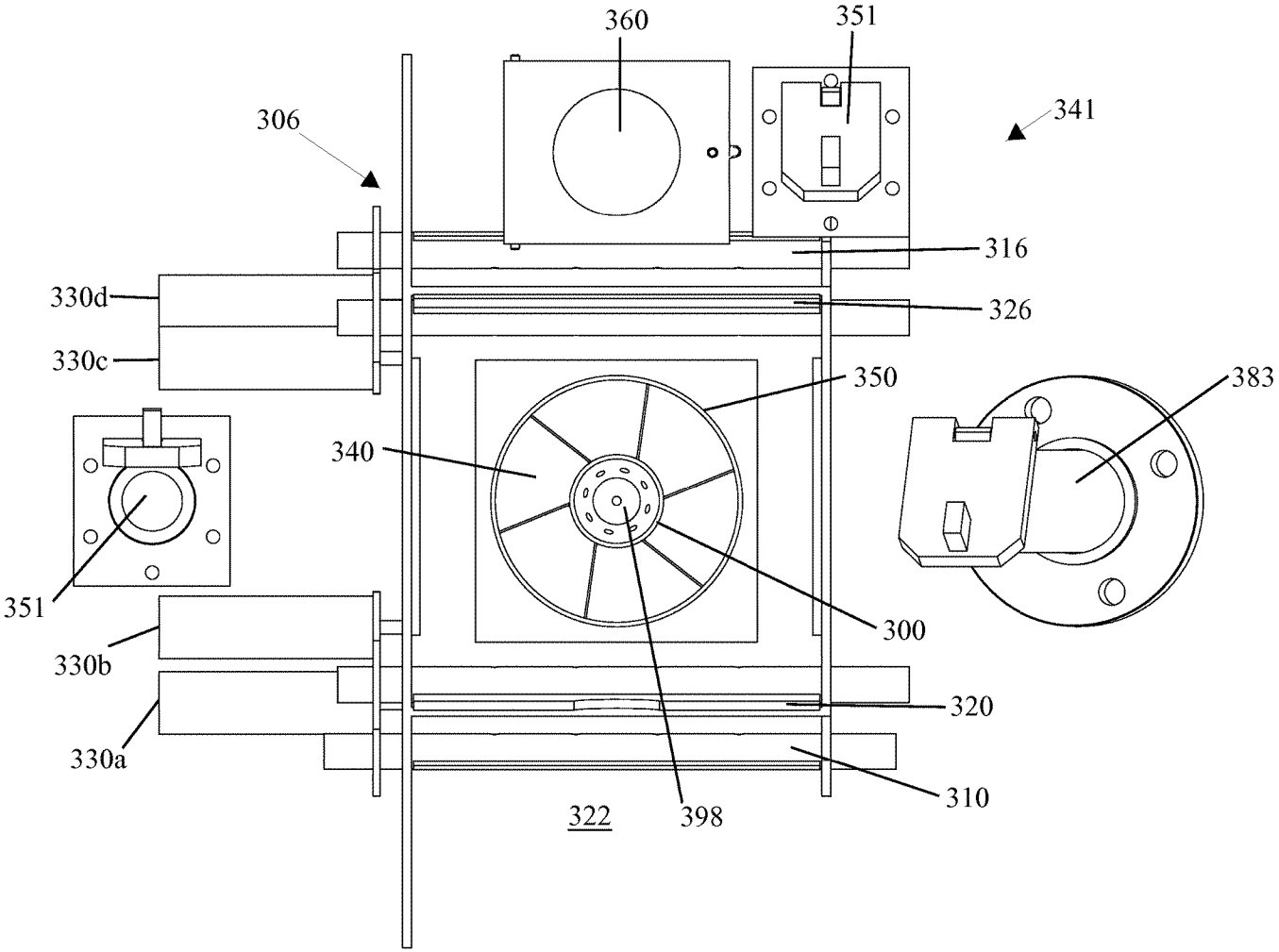
FIG. 3 is a burner end view of an exemplary embodiment of the multi-door isolation chamber, the throat, and the swirler with the outer doors of the multi-door isolation chamber engaged to the front plate of the multi-door isolation chamber via hinges.

FIG. 3 depicts a burner end view of an exemplary multi-door isolation chamber 306 in which the outer doors 310, 316 and inner doors 320, 326 of the multi-door isolation chamber 306 have pivot mechanisms (see 266), which rotate outer doors 310, 316 and inner doors 320, 326 of the multi-door isolation chamber 306. This embodiment further comprises an observation port 360. The swirler 350 is disposed around the fuel nozzle tip 398 and of the startup burner 300. The fuel nozzle tip 398 is located at the firing end of the startup burner 300. In an exemplary method, an operator may look through the observation port 360 to determine the amount of smelt accumulation around the throat 340. If smelt has accumulated, an operator may insert a rod through the multi-door isolation chamber 306 to dislodge the smelt accumulations while the recovery boiler is operational. By inserting a rod through the exemplary multi-door isolation chamber 306, an operator may have a more direct path to the throat 340 and may avoid damage to the swirler 350, which may have been previously caused by poor visibility and suboptimal access due to mechanical interference. An operator may close the bottom inner door 320 to support the startup burner 300 while dislodging smelt. The closed bottom inner door 320 partially protects the operator from stray smelt splatter from the furnace 299. An operator may desirably close either the top outer door 316 or bottom outer door 310 to provide additional protection from stray smelt splatter when cleaning the throat 340. In other embodiments, an operator may extend the rod through a port 351 in the outer wall 322 of the windbox 290. When operators desire to ignite the startup burner 300, operators generally insert an igniter assembly (FIG. 4, 480) through mounting tube 383.

Figure 4:
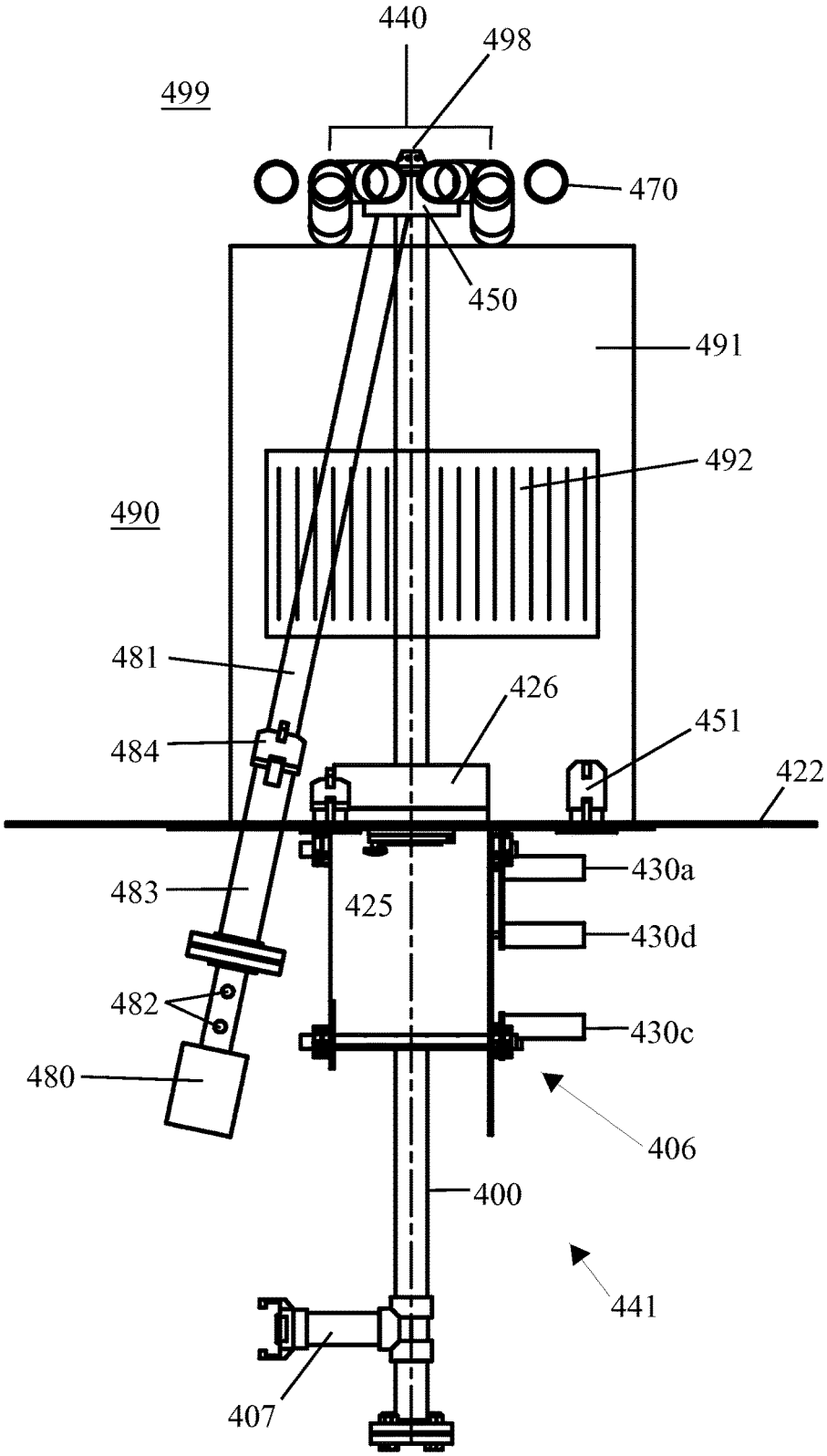
FIG. 4 is a top-down view of an exemplary embodiment of the multi-door isolation chamber mounted to the outer wall of the chemical recovery boiler and the startup burner extending through the windbox and into the furnace.

FIG. 4 is a top-down view of an exemplary startup burner 400 and the swirler 450 extending through the multi-door isolation chamber 406 and the windbox 490 to engage the throat 440. Water wall tubes 470 form the envelope of the furnace 499 and absorb furnace heat. The startup burner 400 may be removed from the windbox 490 through a housing 491 that spans the length of the windbox 490. In some embodiments, the housing 491 may have a variable position damper 492 that may be opened and closed to allow air from the windbox 490 into the housing 491 and into the furnace 499 through the swirler 450 and throat 440. This air maintains combustion at the fuel nozzle tip 498 of the startup burner 400 when active. When the startup burner 400 is dormant or extracted, the variable position damper 492 may be closed substantially completely to prevent air from entering the furnace 499 through the throat 440. In other embodiments, the variable position dampener 492 may be partially open to accommodate a desired air flow.

The startup burner 400 may further be removed from the windbox 490 and housing 491 by using the handle 430*a* to open the bottom inner door 220 of the multi-door isolation chamber 406 and by pulling the startup burner 400 through the internal space 425 of the multi-door isolation chamber 406. After closing the inner doors 220, 226 the startup burner 400 may be partially or substantially completely isolated. Once isolated, the startup burner 400 may be removed through the outer doors 210, 216 of the multi-door isolation chamber 406.

An igniter assembly 480 of the startup burner 400 is depicted in this exemplary embodiment. The igniter assembly 480 may comprise an ionizing flame rod and spark rod 481 and intake ports 482. Air and natural gas may flow through these intake ports 482. A mounting tube 483 can position the igniter assembly 480. This igniter assembly 480 may further comprise safety equipment used to ensure continuous ignition at the fuel nozzle tip 498 of the startup burner 400. The swirler 450 stabilizes and shapes the main flame within the furnace 499. In an exemplary embodiment, the mounting tube 483 of the igniter assembly 480 can engage the outer wall 422 of the windbox 490 outside insolation chamber 406. In another exemplary embodiment, the igniter assembly 480 may be co-extensive with the startup burner 400 and access the windbox 490 through the isolation chamber 406. In an exemplary embodiment, a flapper valve 484 may be engaged to at least one end of the mounting tube 483. This flapper valve 484 may be used to prevent pressure loss from the windbox 490 when the igniter assembly 480 is not in place.

Figure 5A:
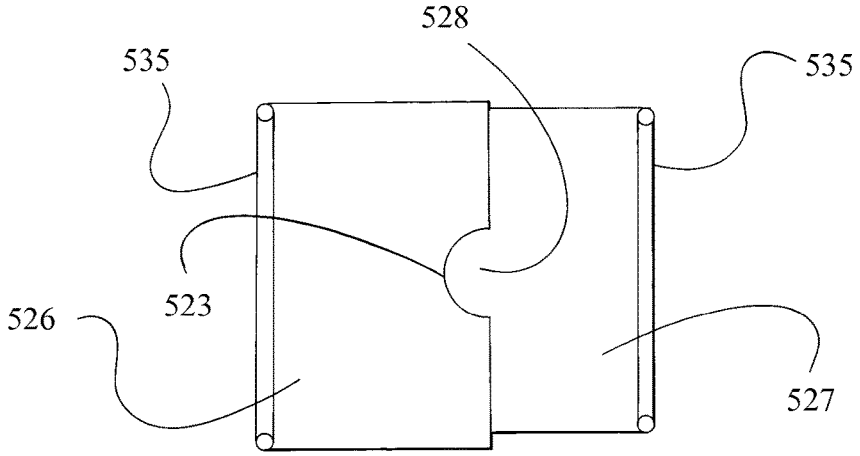
FIG. 5*a* is a front view of an exemplary first inner door and second inner door of the multi-door isolation chamber configured to substantially completely isolate a startup burner in the multi-door isolation chamber.
Figure 5B:
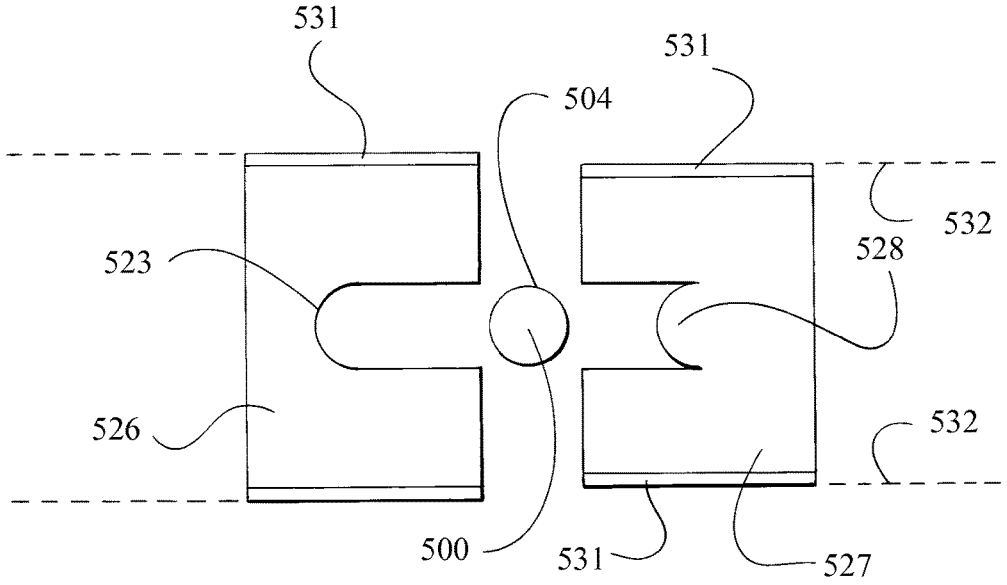
FIG. 5*b* a front view of an exemplary embodiment of the first inner door and second inner door of the multi-door isolation chamber that are slidably engaged proximate to the windbox along a track.

FIG. 5*a* is an exemplary embodiment of the multi-door isolation chamber 206 comprising a first inner door 526 and a second inner door 527 that may rotate on a pivot mechanism 535 such as a hinge or slide along tracks 532 (shown in FIG. 5*b*). It is to be understood by one skilled in the art that outer doors (see FIG. 2, 210, 216) may be configured in similar manner to the inner doors 526, 527 as described herein. A multi-door isolation chamber 206 comprising two or more inner doors 526, 527 may be desirable to isolate the startup burner 500 completely in the multi-door isolation chamber 206 prior to extraction. By closing the two or more inner doors 526, 527, operators substantially reduce the probability that operators will contact stray droplets of liquor flung through the throat 440 of the furnace 499 because these inner doors 526, 527 may be used to close the opening 221 defined by the outer walls of the windbox 290. The first inner door 526 may have a cut-out section 523 configured to complement the perimeter 504 of the startup burner 500. The outer doors may have a cut-out section (see 213) configured to support the startup burner. The first inner door 526 may be substantially closed when removing the startup burner 500 (shown in FIG. 5*b*) such that the cut-out section 523 may be used to support the startup burner 500 as the startup burner 500 is extracted from the windbox 290 of the recovery boiler 107. Once the startup burner 500 is inside the multi-door isolation chamber 206, the second inner door 527 may be closed to substantially completely isolate the startup burner 500 in the multi-door isolation chamber 206. In this embodiment, the second inner door 527 has a flange 528 configured to complement the cut-out section 523 of the first inner door 526. In other embodiments, this flange 528 may be omitted. Although two inner doors 526, 527 are used, it is understood that configurations of inner and outer doors known to those having ordinary skill in the art may be used to isolate the startup burner 500 from the windbox environment and furnace environment.

FIG. 5*b* depicts an exemplary multi-door isolation chamber 206, which comprises a first inner door 526 and a second inner door 527, each having runners 531 configured to slide along tracks 532 disposed on the windbox mounting plate 218. In other embodiments, these tracks 532 may be engaged to the inner wall of the multi-door isolation chamber 406. In still other embodiments, one track per first and second inner door may be utilized. The first inner door 526 may have a cut-out section 523 configured to complement the perimeter 504 of the startup burner 500. The first inner door 526 may be substantially closed when removing the startup burner 500 such that the cut-out section 523 may be used to support the startup burner 500 as the startup burner 500 is extracted from the windbox 290 of the recovery boiler 107. Once the startup burner 500 is inside the multi-door isolation chamber 206, the second inner door 527 may be closed to substantially isolate the startup burner 500 in the multi-door isolation chamber 206. In this embodiment, the second inner door 527 has a flange 528 configured to complement the cut-out section 523 of the first inner door 526. In other embodiments, this flange 528 may be omitted.

Figure 6A:
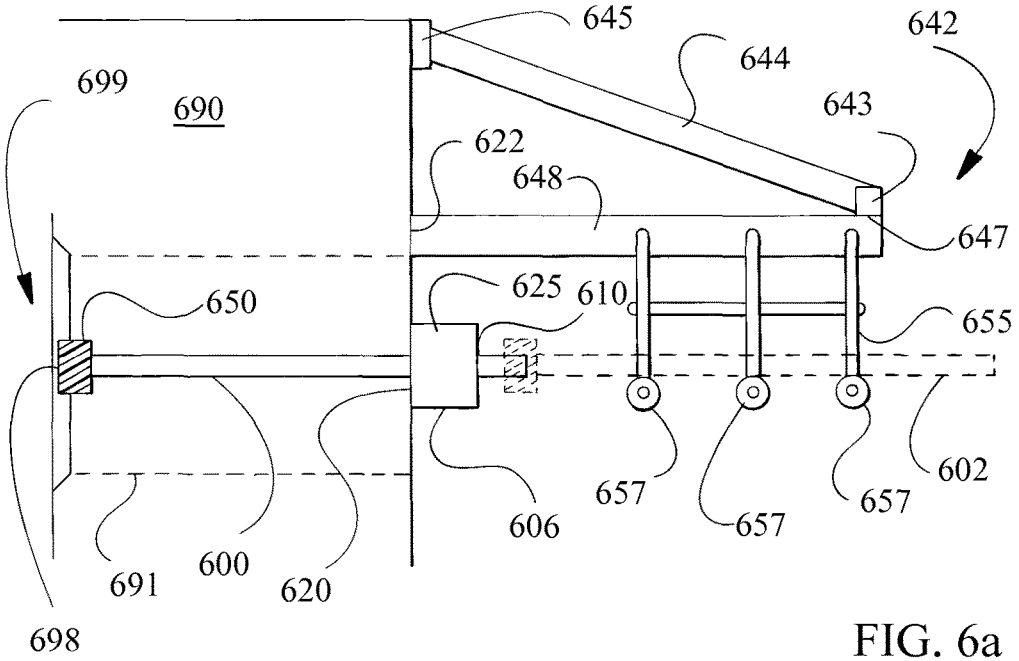
FIG. 6*a* is a side view of an exemplary cooling carriage affixed to the outer wall of a windbox.

FIG. 6*a* is a side view of an exemplary cooling carriage 642 that may be used to hold the startup burner 600 and permit cooling after the startup burner 600 has been removed from the multi-door isolation chamber 606. In this exemplary embodiment, a structural brace 644 having a first end 643 and a second end 645 may be mounted to the outer wall 622 of the windbox 690. In another exemplary embodiment, the second end 645 may be mounted to the recovery boiler 107 such that the cooling carriage 642 remains aligned with the isolation chamber 606 as the recovery boiler expands during operations. A main support beam 648 may have a first end 647 attached to the first end of the structural brace 643 and a second end 649 perpendicularly attached to the outer wall 622 of the windbox 690. In another exemplary embodiment, the second end 649 may be mounted to the recovery boiler 107 such that the cooling carriage 642 remains aligned with the isolation chamber 606 as the recovery boiler expands during operations. A carriage assembly linkage 655 may be rotatably mounted to the main support beam 648 such that the carriage assembly linkage 655 may be secured away from the path 602 of the startup burner 600 when not in use. Rollers 657 may be mounted on at least one end of the carriage assembly linkage 655. These rollers 657 may extend below the path 602 of the startup burner 600 and support the startup burner 600 after the startup burner 600 has been removed from the multi-door isolation chamber 606. Operators may remove the startup burner 600 from the cooling carriage 642 after the fuel nozzle tip 698 of the startup burner 600 has cooled. In other embodiments, at least one clamp, ring, hook, or other similar securing means (not shown) may be used singularly or in combination with other securing means to support the startup burner 600 as it cools.

In an exemplary method, operators may deactivate the startup burner 600 and extract the startup burner 600 and swirler 650 through the housing 691. Operators may then close an inner door 620 and rest the bottom of the startup burner 603 on a cut-out portion 623 of an inner door 620. Once the inner door 620 is closed, operators may pull the startup burner 600 through the internal space 425 of the multi-door isolation chamber 606 and through the outer door of the multi-door isolation chamber 610. Operators may then place the startup burner 600 on the rollers 657 of the carriage assembly linkage 655 and allow the startup burner 600 to cool. Once cool, the operators may remove the startup burner 600 from the cooling carriage 642 and store the cooling carriage 642 away until further needed.

In another exemplary method, the inner door 620 need not be closed before the operator removes the startup burner 600 from the multi-door isolation chamber 606.

Figure 6B:
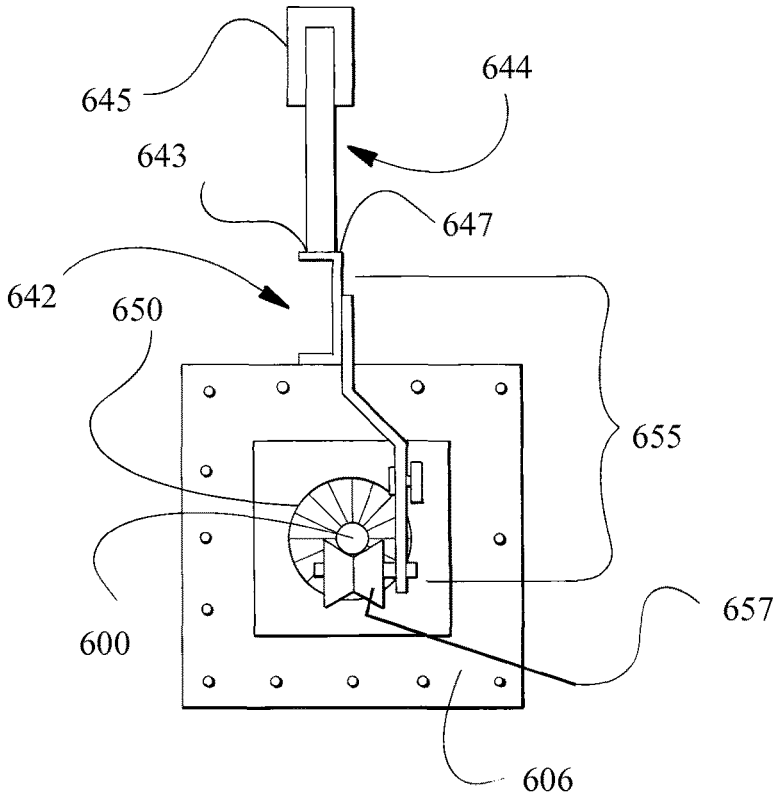
FIG. 6*b* is a front view of an exemplary cooling carriage depicting the extended carriage's position relative to the multi-door isolation chamber.

FIG. 6*b* is a front view of an exemplary cooling carriage 642. The elements correspond to the elements described in FIG. 6*a*. In this exemplary embodiment, the rollers 657 may be contoured to support the startup burner 600 either singularly or in combination with at least one other roller.

Figure 7:
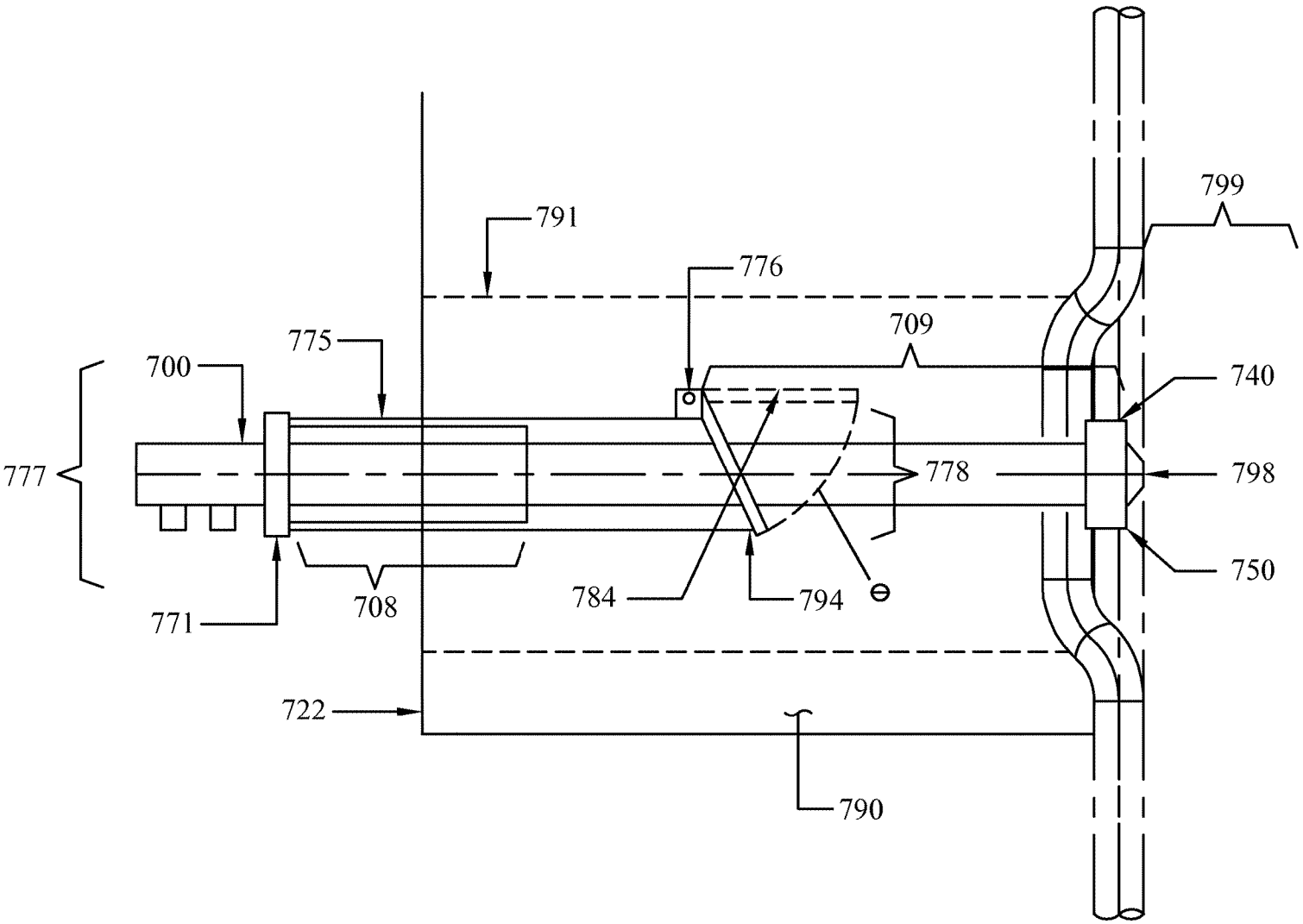
FIG. 7 is a side view of an exemplary burner guide sleeve with a plug and flapper seal.

FIG. 7 depicts an alternative exemplary isolation chamber in the form of a burner guide sleeve 775. This exemplary burner guide sleeve 775 comprises a plug 771 at an outer end 777 of the burner guide sleeve 775 and a flapper valve 784 at an inner end 778 of the burner guide sleeve 775. The burner guide sleeve 775 generally extends into the windbox 790 and may support the startup burner 700 at least partially. The plug 771 may be used to prevent hot air flow from the windbox 790 when the startup burner 700 is in use. The plug 771 may be fixed to the startup burner 700. In another embodiment, the plug 770 may be slidably engaged to the startup burner 700. The plug may be made from a high-density, lightweight material configured to withstand air temperature in the windbox 790. The plug 771 may desirably fill the inner perimeter of the guide sleeve 775 so as to form a seal. In embodiments where the plug 771 is fixed to the startup burner 700, the length 708 of the plug may be at least the length 709 of the distance between the flapper valve 776 and the throat 740. In embodiments where the plug 771 is not fixed to the startup burner 700 but is still configured to maintain a seal, the length 708 of the plug 771 may be less than the length 709 between the flapper valve 776 to the throat 740. In exemplary embodiments in which the startup burner has been extracted from the windbox, the plug 771 may desirably fill the inner perimeter of the guide sleeve and extend through the windbox in substantially the same manner as the startup burner 700 such that the plug 771 may have an end corresponding to the firing end of the startup burner 700 and swirler 750 that substantially blocks the hole left by the extracted swirler 750. The plug 771 may be made of a material generally known in the art, including a poly-amide-based plastic, or other suitable material configured to withstand the heat of the recovery boiler.

The flapper valve 784 may rest on the startup burner 700 when the startup burner 700 interfaces with the throat 740 and furnace 799. When the startup burner 700 is removed past the flapper valve 784, the flapper valve 784 generally closes and rests on the front lip 794 of the guide sleeve 775 at an angle θ. The burner guide sleeve 775 may extend partially through the housing 791 within the windbox 790.

It will be understood that the modifications of FIGS. 3 through 7 could be employed in combination with one another as well as individually in the assembly of FIG. 1 and the assembly illustrated in FIG. 2.

While this invention has been particularly shown and described with references to exemplary embodiments thereof, it will be understood by those skilled in the art that various changes in form and details may be made therein without departing from the scope of the invention encompassed by the appended claims.

What is claimed is:

1. A recovery boiler startup burner assembly comprising:

a furnace having areas defining openings in a furnace wall;

a windbox exteriorly engaging the furnace wall, wherein the windbox is configured to contain pressurized combustion air;

an isolation chamber exteriorly engaging a windbox wall, wherein the isolation chamber is aligned with an area defining a first opening in the windbox wall and an area defining a second opening in the furnace wall, a startup burner disposed within the windbox, the startup burner having an firing end and a supply end, wherein the firing end is aligned with the area defining the second opening in the furnace wall and the supply end is aligned with the area defining the first opening in the windbox wall, wherein the startup burner is configured to be extracted through the isolation chamber, and wherein the isolation chamber is configured to isolate an extracted portion of the startup burner from the windbox.

2. The assembly of claim 1, wherein at least one isolation chamber is a multi-door isolation chamber further comprising an inner door and an outer door.

3. The assembly of claim 2, wherein the inner door further comprises a cut-out section configured to complement a bottom of the startup burner.

4. The assembly of claim 2, wherein the inner door partially isolates the startup burner in at least one multi-door isolation chamber when the inner door is closed.

5. The assembly of claim 1, wherein at least one multi-door isolation chamber further comprises a first inner door opposite a second inner door and an outer door, wherein the first inner door and second inner door further comprise at least one runner slidably engaged to at least one track disposed proximate to an inner wall of the at least one multi-door isolation chamber.

6. The assembly of claim 5, wherein the first inner door has a cut-out section configured to complement a perimeter of the startup burner.

7. The assembly of claim 1 further comprising a cooling carriage exteriorly engaging a wall of the recovery boiler, the cooling carriage comprising a carrier assembly linkage having at least one roller rotatably mounted to the carrier assembly linkage.

8. The assembly of claim 7, wherein at least one first end of the carrier assembly linkage is mounted to the main support beam and at least one second end of the carrier assembly linkage extends below a path of the startup burner.

9. The assembly of claim 7, wherein the cooling carriage further comprises a local temperature display.

10. The assembly of claim 1, wherein at least one isolation chamber is a burner guide sleeve having a plug at an outer end and a flapper valve at an inner end wherein the flapper valve is configured to rest on a front lip of the burner guide sleeve.

* * * * *